United States Patent [19]

Borel et al.

[11] 4,174,284

[45] Nov. 13, 1979

[54] HYDROCARBYLPOLYTHIOBENZOIC ACIDS AS ANTI-OXIDATION ADDITIVES

[75] Inventors: Albert W. Borel, St. Meinrad, Ind.; Bernard A. Baldwin, Bartlesville, Okla.

[73] Assignee: Phillips Petroleum Company, Bartlesville, Okla.

[21] Appl. No.: 933,347

[22] Filed: Aug. 14, 1978

[51] Int. Cl.[2] ..... C10M 1/38

[52] U.S. Cl. ..... 252/48.6; 252/406

[58] Field of Search ..... 252/48.6, 406

[56] References Cited

U.S. PATENT DOCUMENTS

| | | | |
|---|---|---|---|
| 2,371,207 | 3/1945 | Zublin et al. | 252/48.6 X |
| 2,426,496 | 8/1947 | Farley | 252/48.6 X |
| 2,496,798 | 2/1950 | Kluge | 252/48.6 |
| 3,061,619 | 10/1962 | Braunworth et al. | 260/399 |
| 3,158,576 | 11/1964 | Rudel et al. | 252/48.6 |
| 3,278,434 | 10/1966 | Hoffman | 252/48.6 |
| 3,314,888 | 4/1967 | Matson | 252/48.6 |
| 3,514,480 | 5/1970 | Fields | 260/516 |
| 3,600,310 | 8/1971 | Eyres et al. | 252/48.6 |
| 3,730,485 | 5/1973 | Strang et al. | 252/48.6 X |
| 3,755,176 | 8/1973 | Kinney et al. | 252/48.6 |

*Primary Examiner*—Delbert E. Gantz
*Assistant Examiner*—Andrew Metz

[57] ABSTRACT

Liquid hydrocarbon-containing organic compositions have considerably improved anti-oxidation properties when a hydrocarbylpolythiobenzoic acid is present in the composition.

12 Claims, No Drawings

HYDROCARBYLPOLYTHIOBENZOIC ACIDS AS ANTI-OXIDATION ADDITIVES

BACKGROUND OF THE INVENTION

This invention relates to the inhibition of the oxidation of organic compositions comprising a hydrocarbon liquid. In another aspect, this invention relates to inhibiting the oxidation of organic compositions by adding to the composition an additive which will impart the desired properties thereto. In still another aspect, the invention relates to imparting antioxidation properties to an organic composition comprising a hydrocarbon liquid without the use of an additive containing a heavy metal such as zinc. In another aspect, this invention relates to imparting anti-wear as well as antioxidation properties to an organic composition comprising a hydrocarbon liquid. In yet another aspect, this invention relates to a process for rendering a hydrocarbon liquid resistant to oxidation. In still another aspect, the invention relates to improving the anti-oxidation property of a lubricating oil, especially a lubricating oil based on mineral oil. In still another aspect, this invention relates to adding a hydrocarbylpolythiobenzoic acid to an organic composition comprising a liquid hydrocarbon, e.g. lubricating oil, in order to impart to the composition anti-oxidation properties. In another aspect, this invention relates to imparting to a lubricating oil some anti-wear as well as anti-oxidation properties by the addition of a hydrocarbylpolythiobenzoic acid. In another aspect, this invention relates to an organic composition comprising a major proportion of a hydrocarbon liquid and an oxidation-inhibiting amount of a hydrocarbylpolythiobenzoic acid. In still another aspect, this invention relates to an ashless lubricant composition comprising a lubricating oil and a hydrocarbylpolythiobenzoic acid.

For many years, a particularly effective anti-wear and anti-oxidant additive, zinc dialkyldithiophosphate (ZDTP), has been widely used. Despite the fact that this additive has been very effective and very successful in a number of lubricating motor oils, it is presently considered desirable to replace this additive with an ashless additive to reduce environmental pollution. The advent of catalytic exhaust converters on the automobile scene has precluded the use of lead compounds or other similar materials in gasolines in order to prevent premature fouling of the catalysts. Therefore, the elimination of heavy metal compounds such as zinc compounds from motor oils is also under strong consideration in order to avoid the migration of such substances through the combustion chamber and into the catalytic zone. Consequently, a substantial effort has been made to find a replacement for ZDTP which would not only be as effective but which would also be free of elements such as zinc or phosphorous.

Alkylthiobenzoic acids are known in the art as anticorrosion agents for hydrocarbon liquids such as lubricating oils. Such compounds are disclosed in U.S. Pat. No. 3,755,176. Although alkylthiobenzoic acids can be used successfully as anti-corrosion and anti-wear additives, the anti-oxidation properties such compounds impart to a hydrocarbon liquid containing organic composition such as a lubricating oil still leaves much to be desired. Therefore, when it is desirable for an organic composition such as a lubricating composition to have anti-oxidation protection, it would be desirable to have a nonheavy metal-containing additive which can impart excellent anti-oxidation properties to the lubricating oil.

Accordingly, it is an object of this invention to provide an organic composition comprising a hydrocarbon liquid having improved anti-oxidation properties.

Another object of this invention is to provide an additive for an organic composition such as a lubricating oil in order to impart to the lubricating oil improved anti-oxidation properties.

Still another object of this invention is to provide an organic composition comprising a hydrocarbon liquid having improved anti-oxidation properties but does not contain a metal containing compound such as a zinc compound.

Yet another object of this invention is to provide a process for rendering a hydrocarbon oil resistant to oxidation.

Other objects, aspects, and the several advantages of this invention will be apparent to those skilled in the art upon a study of this disclosure and the appended claims.

SUMMARY OF THE INVENTION

In accordance with the invention, there is provided an organic composition comprising a hydrocarbon liquid and an oxidation-inhibiting amount of a hydrocarbylpolythiobenzoic acid. Although hydrocarbylpolythiobenzoic acids impart some anti-wear properties, it is the truly outstanding anti-oxidation properties imparted to the composition for which the hydrocarbylpolythiobenzoic acids are preferably used as additives.

In one of the preferred embodiments of the invention, a hydrocarbylpolythiobenzoic acid is added to a lubricating oil to form an ashless lubricant composition comprised of the lubricating oil and the hydrocarbylpolythiobenzoic acid.

DETAILED DESCRIPTION OF THE INVENTION

The anti-oxidation and anti-wear additive of the present invention is a hydrocarbylpolythiobenzoic acid. The preferred additives of the invention can be represented by the formulas:

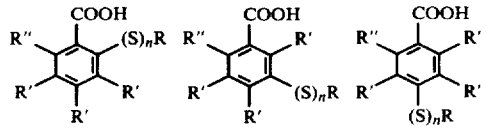

I. II. III.

wherein R can be an alkyl, cycloalkyl, or aromatic hydrocarbon radical having from 2 to about 36, preferably from about 10 to 18, carbon atoms; R' can be hydrogen or R; R'' is hydrogen; and n can be 2 to 8, preferably 2 to 4. A mixture of compounds can also be employed in the invention.

Some examples of suitable compounds are 2-n-hexyldithiobenzoic acid, 2-n-octyldithiobenzoic acid, 2-n-dodecyldithiobenzoic acid, 2-n-pentadecyldithiobenzoic acid, 2-n-octadecyldithiobenzoic acid, 2-n-octyldithio-3,4,5-trimethylbenzoic acid, 2-n-octyldithio-4-cyclohexylbenzoic acid, 2-n-octyldithio-4-phenylbenzoic acid, 2-phenyldithio-4-n-octylbenzoic acid, and 2-n-dodecyltetrathio-4-cyclohexylbenzoic acid. A mixture of said compounds can also be employed.

Also, the hydrocarbylpolythio substituent, —$(S)_nR$, can be in either the ortho, meta, or para position relative to the acid position. Some examples of such compounds are 3-n-hexyldithiobenzoic acid, 3-n-octyldithiobenzoic acid, 3-n-octyldithio-2,4,5-trimethylbenzoic acid, 4-n-octyldithio-2,3,5-trimethylbenzoic acid, and 4-n-hexyldithiobenzoic acid.

The hydrocarbylpolythiobenzoic acid of the present invention is employed in an oxidation inhibiting amount, which is such amount as necessary to impart the desired anti-oxidation properties, with a hydrocarbon liquid in a major proportion. The additive is usually employed in the range of about from 0.1 to 6 wt. % of the total composition although it is preferred that the additive be used in the range of 0.5 to 2 wt. % of the total composition.

The hydrocarbylpolythiobenzoic acids of the present invention can be considered to be derivatives of mercaptobenzoic acid and, therefore, can be prepared by any suitable means in the art such as the reaction of a hydrocarbyl sulfenyl halide with a mercaptobenzoic acid.

The organic composition into which the present anti-oxidation/anti-wear additive can be formulated can be any such organic composition comprising a hydrocarbon liquid in which anti-wear or anti-oxidation protection is desirable. Thus, such compositions can include motor oils, greases, automatic transmission oils, cutting oils, hydraulic fluids, and the like. The present invention additives, however, are found to be particularly suitable for incorporation into motor oil or lubricating oil for the lubrication of an automotive engine.

It is preferred, therefore, to add the hydrocarbylpolythiobenzoic acids to lubricating oils to form a lubricating composition. The preferred lubricating compositions of the invention are based on mineral oils such as those of petroleum origin and are preferably refined mineral oils produced by wellknown refining processes employing techniques such as hydrogenation, polymerization, dewaxing, solvent extraction, etc. These oils generally have a Saybolt viscosity at 37.8° C. (100° F.) in the range of about 60 to 5,000 and a Saybolt viscosity at 99° C. (210° F.) of from about 30 to 250. The mineral oils can be paraffinic, naphthenic, or aromatic, or mixtures of these.

When the lubricants employed are in the form of a grease, the lubricant composition will contain a suitable grease thickener such as a lithium soap or a hydrocarbon polymer. Such grease compositions are well known in the art, and they are generally prepared by dissolving soaps and/or polymers in the oil at elevated temperatures.

In addition to the anti-oxidation/anti-wear additives, the lubricating oil composition can contain other conventional components such as viscosity index improvers, pour point depressants, anti-foam agents, anti-corrosion agents and the like.

The following examples serve to illustrate the operability of the present invention. The following examples are not intended to limit the invention in any way, however, and are only given for illustration.

EXAMPLE I

Preparation of 2-n-Octyldithiobenzoic Acid

1-Octanethiol (14.6 grams, 0.10 mole) was dissolved in 100 milliliters of heptane in a 500 milliliter, three-necked, roundbottom flask fitted with a truebore stirrer, addition funnel, and nitrogen cap. Sulfury chloride (13.5 grams, 0.10 mole) was placed in the addition funnel and added as rapidly as possible. The resulting yellow solution was stirred for thirty minutes. Then 200 milliliters of benzene was added to dilute the reaction mixture. Subsequently, 2-mercaptobenzoic acid (15.4 grams, 0.10 mole) was added and the mixture stirred for 3 hours. The reaction mixture was filtered and the filter cake recrystallized from methanol to yield 19.3 grams of a material melting at 73°-75° C. (163°-167° F.) for a 65 mole percent yield. The infrared spectrum of this material was consistent with what would be expected of the desired product. Elemental analysis calculated for $C_{15}H_{22}O_2S_2$: %C, 60.36; %H, 7.43; %S, 21.49; Neut. Equiv. 188 mg KOH/gm. Found: %C, 60.30; %H, 7.56; %S, 21.68; Neut. Equiv. 142 mg KOH/gm.

EXAMPLE II

Preparation of 2-n-Dodecyldithiobenzoic Acid

1-Dodecanethiol (20.2 grams, 0.10 mole) was dissolved in 100 milliliters of heptane in a 500 milliliter, three-necked roundbottom flask fitted with a truebore stirrer, addition funnel, and nitrogen cap. Sulfuryl chloride (13.5 grams, 0.10 mole) was placed in the addition funnel and added as rapidly as possible. The resulting yellow solution was stirred for 30 minutes. Then 2-mercaptobenzoic acid (15.4 grams, 0.10 mole) was dissolved in 200 milliliters of benzene and the solution subsequently added to the reaction mixture. The reaction mixture was stirred for 3 hours and vacuum filtered. The filter cake was recrystallized from methanol twice to yield 19.8 grams of a material melting at 91°-93° C. (196°-199° F.) for a 56 mole percent yield. The infrared spectrum of this material was consistent with what would be expected of the desired product. Elemental analysis calculated for $C_{19}H_{30}O_2S_2$: %C, 64.36; %H, 8.53; %S, 18.09; Neut. Equiv. 158 mg KOH/gm. Found: %C 63.72; %H, 8.62; %S, 18.53; Neut. Equiv. 163 mg KOH/gm.

EXAMPLE III

The anti-oxidation additive, 2-n-octyldithiobenzoic acid, was incorporated at 0.5 wt. % into a white paraffinic mineral oil[a] and the oxidation resistance of the composition tested essentially as described in ASTM Test Method D 2272-67. Basically the method consists of putting a covered glass container of the oil and additive to be tested in a sealed metal bomb placed in a constant-temperature oil bath at 150° C. (302° F.), pressuring the bomb to 620 kPa (90 psig) with $O_2$ and measuring the time required for a 172 kPa (25 psig) pressure drop while the bomb and contents are rotated axially at 100 rpm at an angle of 30 degrees from the horizontal. The time observed for a 172 kPa (25 psig) pressure drop for the oil/additive composition was 140 mins. The experiment was again repeated with another inventive compound, 2-n-dodecyldithiobenzoic acid and the pressure change observed to be 127 mins. The results in Table I show the outstanding oxidation resistance obtained with the present invention compared to a control, no additive, a second control where a commonly used zinc dialkyldithiophosphate (ZDTP) is employed, and three alkylthiobenzoic acid additives which were tested in accordance with the method described above.

Table I

| Anti-Oxidation Tests | Time for 172 kPa (25 psig) Pressure Change mins |
|---|---|
| A. Control Runs | |
| 1. Mineral oil[a] (no additive present) | 18 |
| 2. Mineral oil[a] + 0.5 wt. % ZDTP | 80 |
| 3. Mineral oil[a] + 0.5 wt. % 2-n-octylthiobenzoic acid | 32 |
| 4. Mineral oil[a] + 0.5 wt. % 2-n-dodecylthiobenzoic acid | 105 |
| 5. Mineral oil[a] + 0.5 wt. % 2-n-pentadecylthiobenzoic acid | 7 |
| B. Inventive Runs | |
| 6. Mineral oil[a] + 0.5 wt. % 2-n-dodecyldithiobenzoic acid | 127 |
| 7. Mineral oil[a] + 0.5 wt. % 2-n-octyldithiobenzoic acid | 140 |

[a]Sontex 35 (Marathon Norco Co.), pretreated with sulfuric acid to remove aromatics: viscosity at 38° C., 57 centistokes, at 100° C., 7.1 centistokes.

EXAMPLE IV

The anti-wear properties imparted by a hydrocarbylpolythiobenzoic acid were determined by using 2-n-dodecyldithiobenzoic acid and incorporating the additive at 0.5 wt. % into a white paraffinic mineral oil as herein defined and measuring the anti-wear properties by the Falex method using a modified ASTM D2670-67 method. For purposes of comparison, similar lubricating compositions containing another invention additive, 2-n-octyldithiobenzoic acid, the well-known ZDTP additive, and three alkylthiobenzoic acid additives were also prepared and their wear properties also measured.

The wear tests were carried out using the well-known Falex test machine in accordance with a slight modification of the ASTM D2670-67 procedure. In the procedure used, a rotating steel pin, 0.635 cm (0.25 in.) in diameter was rotated at 290 rpm between the two "V" steel blocks for one-half hour of break-in at an applied load of 23 Kg (50 lb.) followed by 3 hours of additional testing at 113 kg (250 lb.) applied load. During this time, the rotating pin and "V" blocks were submerged in 60 g of the test oil. During the break-in period, the oil, pin, and "V" blocks were heated to 79.5° C. (175° F.). However, the temperature was not controlled during the test period but was allowed to increase or decrease depending upon the amount of frictional heat produced during the tests.

The wear was measured by the number of radical degrees or teeth which a ratchet wheel pressure loader must be advanced to maintain a constant pressure during the course of the test. A low wear-teeth number is desirable since the lower the number, the less the wear, the more effective the anti-wear additive. Table II shows the results of this test.

TABLE II

| Anti-Wear Tests | Wear-Teeth[a] |
|---|---|
| 1. Mineral oil[b] (no additive present) | >100 |
| 2. Mineral oil[b] + 0.5 wt. % ZDTP | 22.9 |
| 3. Mineral oil[b] + 0.5 wt. % 2-n-octylthiobenzoic acid | 6.5 ± 2.5 |
| 4. Mineral oil[b] + 0.5 wt. % 2-n-dodecylthiobenzoic acid | 9.0 ± 5.0 |
| 5. Mineral oil[b] + 0.5 wt. % 2-n-pentadecylthiobenzoic acid | 15.5 ± 3.5 |
| 6. Mineral oil[b] + 0.5 wt. % 2-n-dodecyldithiobenzoic acid | 40.7 ± 7 |
| 7. Mineral oil[b] + 0.5 wt. % 2-n-octyldithiobenzoic acid | 85.7 ± 5 |

[a]The lower the number, the less the wear, the more effective the anti-wear additive.
[b]Sontex 35 (Marathon Norco Co.)

SUMMARY

The results herein described are summarized in Table III where it is shown that when representative type compounds of the invention, 2-n-octyldithiobenzoic acid and 2-n-dodecyldithiobenzoic aicd, are incorporated into lubricating oils the oxidation resistance of the oil is greatly enhanced. The additives also contribute somewhat to wear resistance, although not as good as ZDTP or nearly as good as the alkylthiobenzoic acid additives. The oxidation resistance imparted by the hydrocarbylpolybenzoic acid additives, however, are far superior to that imparted by the other additives, therefore, making the use of hydrocarbylpolybenzoic acid additives most desirable for anti-oxidation protection.

TABLE III

| Summary | Wear-Teeth | Time for 172 kPa (25 psig) Pressure change, mins. |
|---|---|---|
| 1. Mineral oil[a] (no additive present) | >100 | 18 |
| 2. Mineral oil[a] + 0.5 wt. % ZDTP | 22.9 | 80 |
| 3. Mineral oil[a] + 0.5 wt. % 2-n-octylthiobenzoic acid | 6.5 ± 2.5 | 32 |
| 4. Mineral oil[a] + 0.5 wt. % 2-n-dodecylthiobenzoic acid | 9.0 ± 5.0 | 105 |
| 5. Mineral oil[a] + 0.5 wt. % 2-n-pentadecylthiobenzoic acid | 15.5 ± 3.5 | 7 |
| 6. Mineral oil[a] + 0.5 wt.% 2-n-dodecyldithiobenzoic acid | 40.7 ± 7 | 127 |
| 7. Mineral oil[a] + 0.5 wt. % 2-n-octyldithiobenzoic acid | 85.7 ± 5 | 140 |

[a] Sontex a(Marathon Norco Co.)

Reasonable variations and modifications are possible within the scope of the foregoing disclosure and the appended claims to the invention.

We claim:

1. An organic composition comprising a major proportion of a hydrocarbon liquid and an oxidation-inhibiting amount of a hydrocarbylpolythiobenzoic acid.

2. A composition in accordance with claim 1 wherein said hydrocarbylpolythiobenzoic acid is selected from the group consisting of:

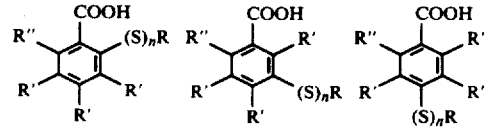

I II III wherein R is an alkyl, cycloalkyl or aromatic hydrocarbon radical having from 2 to about 36 carbon atoms, R' is hydrogen or R, R'' is hydrogen, and n is an integer from 2 to 8.

3. A composition in accordance with claim 2 wherein R contains from about 10 to about 18 carbon atoms and n is an integer from 2 to 4.

4. The composition of claim 1 comprising from about 0.1 to about 6 percent by weight of said hydrocarbylpolythiobenzoic acid.

5. The composition of claim 1 comprising from about 0.5 to about 2 percent by weight of said hydrocarbylpolythiobenzoic acid.

6. The composition of claim 1 wherein said hydrocarbon liquid is a lubricating oil.

7. The composition of claim 6 wherein said lubricating oil is based on a mineral oil.

8. The composition of claim 2 wherein said hydrocarbylpolythiobenzoic acid is selected from the group of 2-n-octyldithiobenzoic acid or 2-n-dodecyldithiobenzoic acid.

9. A method for rendering a hydrocarbon liquid resistant to oxidation by incorporating into said hydrocarbon liquid an oxidation-inhibiting amount of a hydrocarbylpolythiobenzoic acid.

10. A method in accordance with claim 9 wherein said hydrocarbon liquid is a lubricating oil and the hydrocarbylpolythiobenzoic acid is incorporated into said lubricating oil in the range of about 0.1 to 6 percent by weight of the total composition.

11. A method in accordance with claim 10 wherein said hydrocarbylpolythiobenzoic acid is incorporated at a weight percent in the range of about 0.5 to about 2 of the total composition.

12. A method in accordance with claim 9 wherein said hydrocarbylpolythiobenzoic acid is 2-n-octyldithiobenzoic acid or 2-n-dodecyldithiobenzoic acid.

* * * * *